United States Patent [19]

Casebier

[11] 4,143,795

[45] Mar. 13, 1979

[54] REFRIGERATOR BEVERAGE DISPENSERS

[76] Inventor: John P. Casebier, 1204 11th Ave., Vero Beach, Fla. 32960.

[21] Appl. No.: 809,535

[22] Filed: Jun. 24, 1977

[51] Int. Cl.[2] ..... B67D 5/60

[52] U.S. Cl. ..... 222/143; 222/185; 211/126; 211/49 D; 220/23.4

[58] Field of Search ..... 222/129, 129.1, 132, 222/135, 173, 180, 181, 183, 185, 143, 507; 312/257 SK, 257 SM, 258, 192; 211/126, 49 R, 49 D, 84, 71; 220/23.4; 62/337, 338, 377, 465

[56] References Cited

U.S. PATENT DOCUMENTS

| | | | |
|---|---|---|---|
| 1,064,173 | 6/1913 | Schuhle | 222/143 |
| 3,285,474 | 11/1966 | Gran | 222/185 |
| 3,315,850 | 4/1967 | Gran | 222/501 |
| 3,325,058 | 6/1967 | West | 222/183 |
| 3,830,406 | 8/1974 | Robb | 222/185 |

FOREIGN PATENT DOCUMENTS

| | | | |
|---|---|---|---|
| 390141 | 7/1965 | Switzerland | 211/126 |

*Primary Examiner*—Allen N. Knowles
*Assistant Examiner*—H. Grant Skaggs
*Attorney, Agent, or Firm*—Carroll F. Palmer

[57] ABSTRACT

New refrigerator beverage dispensers comprise multiple containers fitted in a rack that can rest on the shelf of a refrigerator. The front of each container is concave to accommodate a cup or like receptacle for filling from a dispenser spout that extends forward from the bottom of the container front. The containers may be removed from the rack by sliding forward when a retaining gate hinged to the front of the rack is lowered or the rack and containers may be removed as a unit from the refrigerator. Several embodiments of filler cups for the containers are disclosed to allow the containers to be easily filled or cleaned.

9 Claims, 11 Drawing Figures

FIG.4
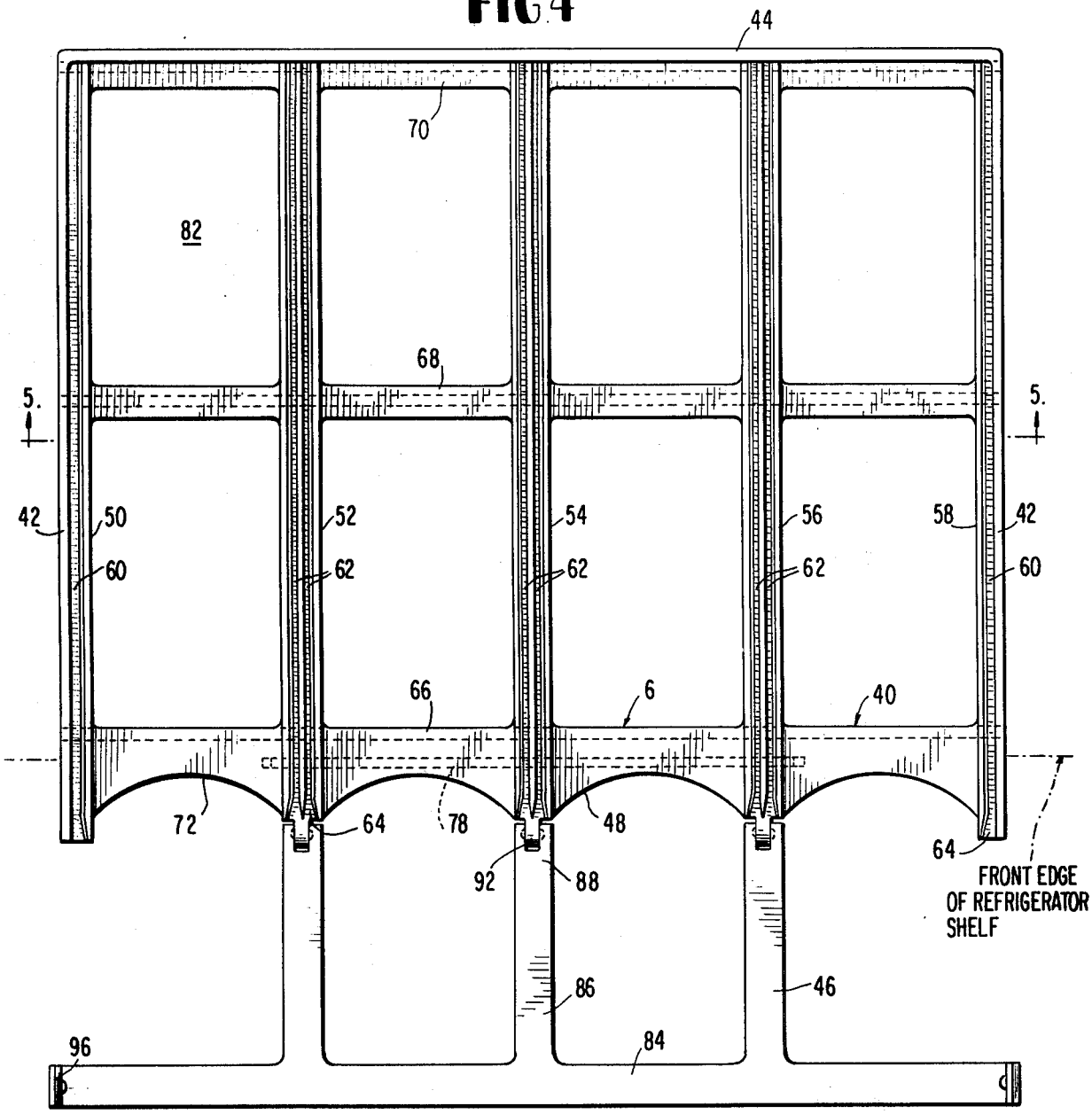
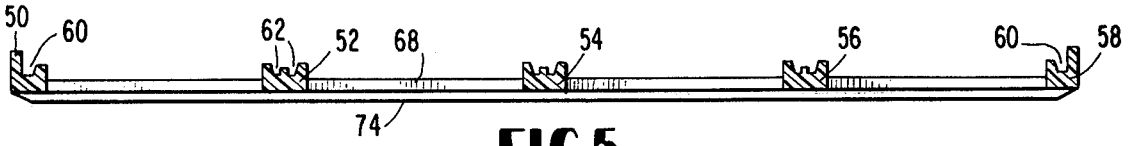
FIG.5
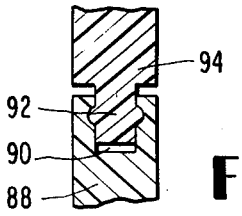
FIG.6
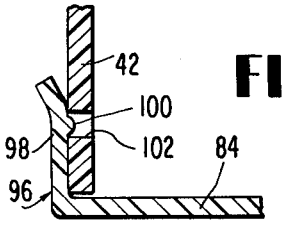
FIG.7

FIG. 8
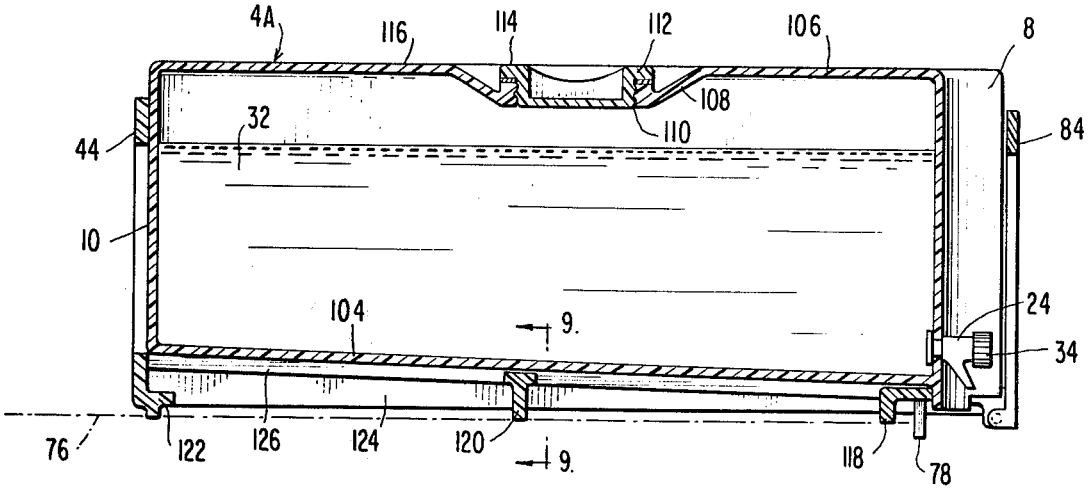
FIG. 9
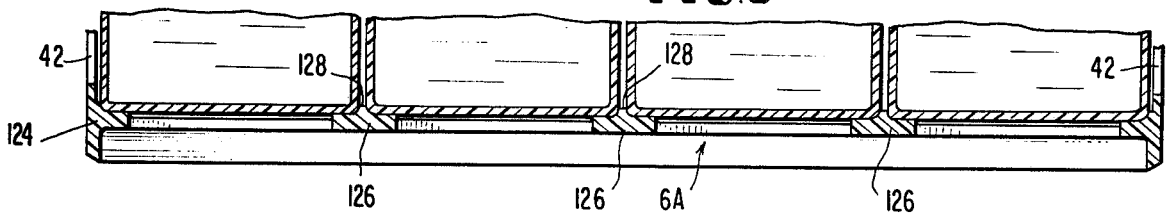
FIG. 10
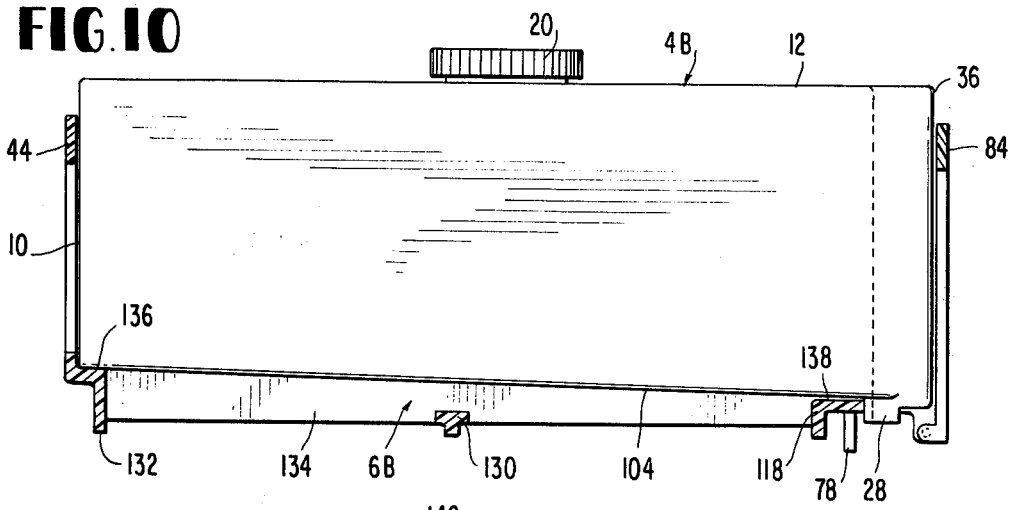
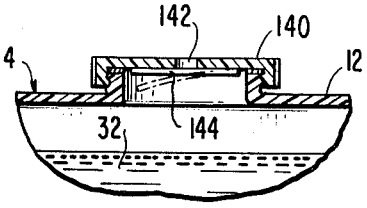
FIG. 11

REFRIGERATOR BEVERAGE DISPENSERS

BACKGROUND OF THE INVENTION

1. Field of the Invention

This invention relates to beverage cooling and dispensing devices. More particularly, it concerns new forms of multiple beverage container assemblies that may be placed in domestic refrigerators for cooling and from which beverages may be dispensed with ease as desired.

2. Description of the Prior Art

It is common pratice to store numerous containers of different size and shape in domestic refrigerators to cool their contents, e.g., milk, water, fruit juices and other beverages. Because of the size and shape variations of the containers, efficient use of shelf space is difficult to attain. Moreover, frequently, a container holding the desired beverage is at the rear of a shelf which presents the annoyance of removing an unwanted article from the shelf to obtain access to the required container. Such problems of refrigerator storage and use of beveage containers has prompted the conception and development of numerous devices atteptimg to overcome them.

One solution has been to provide containers that are located within a refrigerator from which beverages may be dispensed without opening the refrigerator door (see U.S. Pat. No. 2,408,704). Such devices are invariably expensive, usually require special refrigerator construction and may cause as much loss of refrigeration energy as they are intended to save by reducing the number of times the refrigerator is opened.

Containers with dispenser spouts designed to slide onto refrigerator shelves have been developed (see U.S. Pat. No. 1,905,133 and 2,027,092). Alternatively, the drink coolers may be carried on special racks mounted in the refrigerator and the dispenser front of the device may be contoured to mount the dispenser spout (see U.S. Pat. No. 1,936,517). Also, this general type device has been made with multiple containers that can be held assembled on a rack (see U.S. Pat. No. 3,178,061).

In spite of the many prior art refrigerator dispensers that have been developed, there is a need for improvements, e.g., lower cost, elimination of need to alter the refrigerator structure, increased ease of use and cleaning, etc.

OBJECTS

A principle object of this invention is the provision of new improvements in beverage dispensers to be stored in domestic refrigerators for cooling and delivery of beverages.

Further objects include the provision of such dispensers: 1. That comprise a plurality of containers held in a rack constructed so as to economize shelf space. 2. That may be easily removed from a refrigerator for cleaning or use at some other location, e.g., at a picnic or other outing.

3. That may be formed of plastic material and manufactured inexpensively.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of refrigerator beverage dispensers that comprise a plurality of longitudinally elongated containers fitted into a retainer rack gated at the front to permit the containers to be inserted or withdrawn individually from the rack while it remains in position upon the shelf of a refrigerator.

The front of each container is concave permitting a cup or like receptacle to closely approach the container and receive liquid discharged through a spout fitted in the front of the container at the base thereof. There is a central filler opening in the top of each container and a removable cap is provided to close each such opening. The containers are held in the rack so that the bottoms thereof slope downwardly toward the front of the rack. This bottom sloping may be attained in different ways. Also, there are several embodiments of the container openings and closure caps.

BRIEF DESCRIPTION OF THE DRAWINGS

A more complete understanding of the invention may be had by reference to the accompanying drawings in which:

FIG. 4 is a plan view of a rack for the dispensers of the invention shown with the gate thereof open.

FIG. 5 is a sectional view taken on the line 5—5 of FIG. 4.

FIG. 6 is an enlarged, fragmentary sectional view of a hinge for the gate of the dispenser rack.

FIG. 7 is an enlarged, fragmentary sectional view of a latch for the gate of the dispenser rack.

FIG. 8 is a lateral sectional view of another embodiment of the invention.

FIG. 9 is a fragmentary, sectional view taken on the line 9—9 of FIG. 8.

FIG. 10 is a lateral sectional view of another embodiment of the invention.

FIG. 11 is a fragmentary sectional view of a capped top opening of a container of the invention.

DESCRIPTION OF THE PREFERRED EMBODIMENTS

Figure 1:
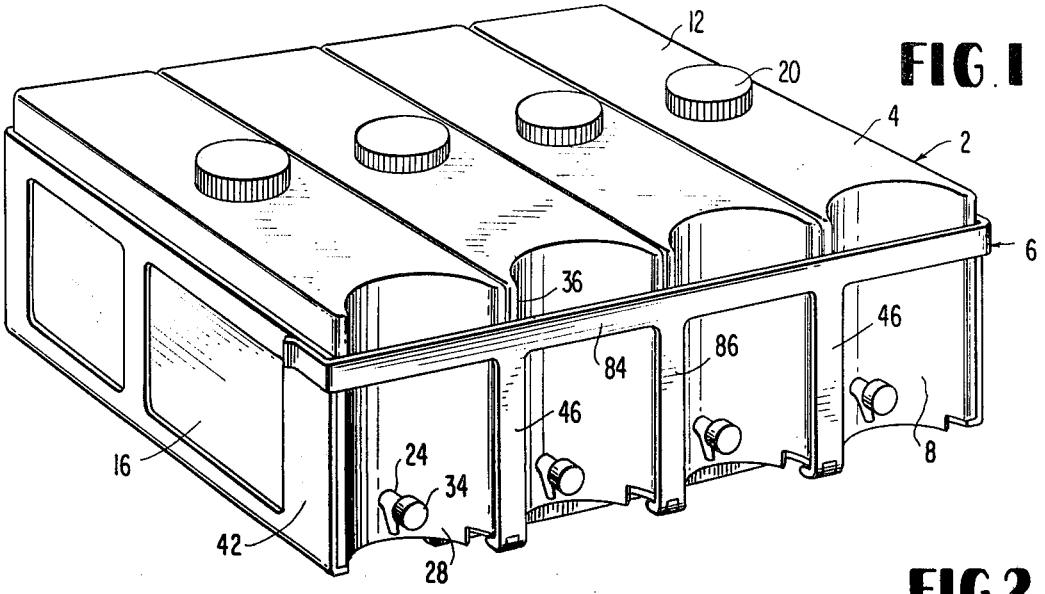
FIG. 1 is an isometeric view of a refrigerator beverage dispenser of the invention.

Referring in detail to the drawings, the refrigerator beverage dispenser 2 comprises a plurality of containers 4 and a rack 6.

The containers 4 have a concave front 8 and substantially flat back 10, top 12, bottom 14 and parallel sides 16. Each container top 12 has a central filler opening 18 with a removable cap 20 held in position closing the opening 18 by threads 22.

Figure 2:
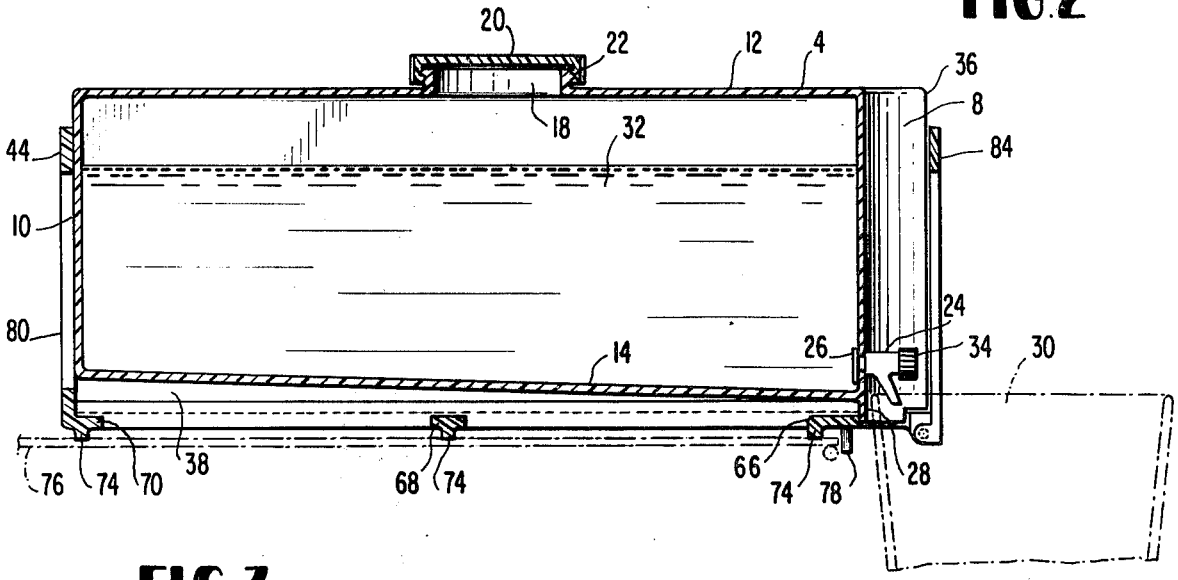
FIG. 2 is a lateral sectional view taken on the line 2—2 of FIG. 1.
Figure 3:
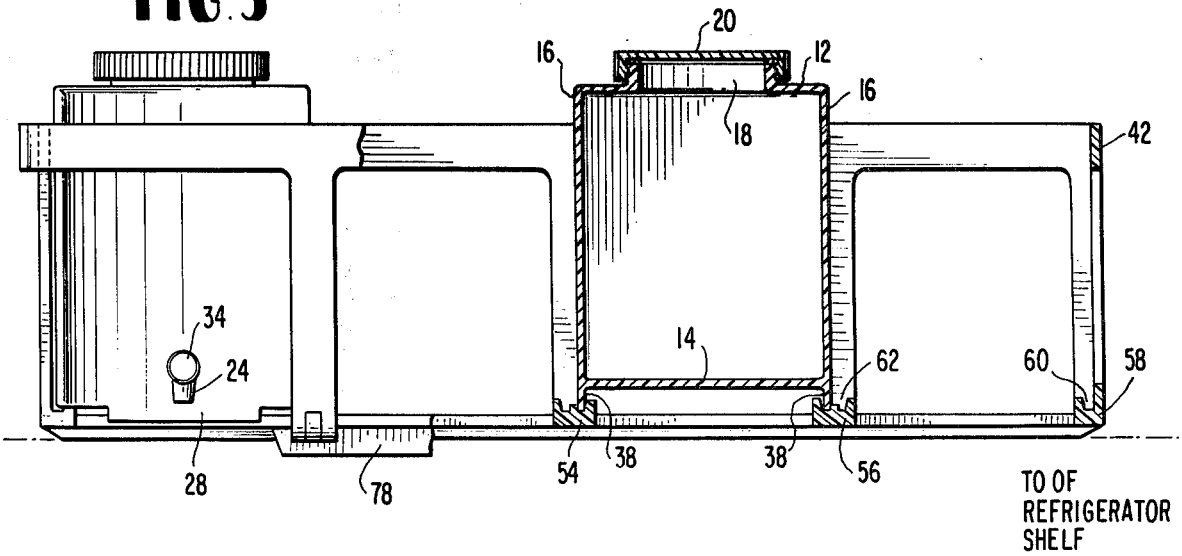
FIG. 3 is an anterior view partially in section of the dispenser of FIG. 1 with two containers removed.

A spout 24 is fixed such as by flange 26 on the front 8 of each container adjacent the lower end 28 of the front 8. The concave shape of fronts 8 (see FIG. 2) enable a cup 30 or like receptable to closely approach the container 4 when liquid 32 in the container is withdrawn through the spout 24. This concave shape also enables the push-bottom valves 34 of spouts 24 to be recessed behind the forward vertical edges 36 of container fronts 8 to prevent the valves 34 from being accidentally operated by contact with the refrigerator door.

A pair of parallel runners 38 extend longitudinally along the bottom 14 of each container 4. The runners 38 taper downwardly in height from the back 10 to the front 8 of the container. Since the containers 4 rest on the runners 28, the bottoms 14 of the containers pitch forward to obtain full drainage of liquid from the containers.

The rack 6 comprises a base 40, parallel sides 42, a back 44 and a gate 46 hinged to the base 40 at the front 48 of the rack.

The rack base 40 comprises parallel longitudinal ribs 50, 52, 54, 56 and 58, i.e., they exceed by one the number of the containers held by the rack. These ribs are spaced apart from each other approximately the width of the containers 4. The outside ribs 50 and 58 have single guide grooves 60 formed in their upper surface into which the runners 38 of containers 4 extend when the containers are positioned in the rack 6. For the same purpose, the inside ribs 52, 54 and 56 have double guide grooves 62 formed in their upper surface. All of the grooves 60 and 62 have flared ends 64 to facilitate insertion of the container runners 38 into the grooves 60 and 62.

The rack base also comprises parallel transverse ribs 66, 68 and 70. The front rib 66 is contoured with concave forward edges 72 complimentary in shape to the concave fronts 8 of the containers 4 thereby forming stop means for the lower ends 28 of fronts 8 of the containers when they are pushed into the rack 6 (see FIG. 2).

The transverse webs 66-70 are provided on their undersurfaces with projections 74 that extend below the lower horizontal level of the longitudinal ribs 50-58. These projections 74 provide bearing surfaces for the rack upon the shelf 76 of the refrigerator (not shown).

A stop flange 78 depends from the transverse rib 66 at the front of the rack 6. It serves to limit movement of the rack backward on the shelf 76 (see FIG. 2).

The sides 42 and back 44 of the rack 6 may be solid panels, but advantageously they are formed with open portions 80 for reduction in weight and material cost. Similarly, the base 40 could be formed as a solid panel with integral ribs, if desired, rather than with open portions 82 as shown (see FIG. 4).

The gate 46 comprises a horizontal strip 84 and integral vertical strips 86. The lower ends 88 (see FIG. 6) of strips 86 have slots 90 that receive the beaded projections 92 that extend from the front ends 94 of the longitudinal ribs 52-56. This structure forms hinges that permit the gate 46 to be moved from a closed position (FIG. 1) to an open position (FIG. 4).

The gate 46 has latch means 96 to fasten the gate in the closed position. The means 96 comprise a flange 98 normal to the strip 84. The flange 98 has a bead 100 that extends into a hole 102 formed in the rack side wall 42.

The containers 4 and rack 6 may be formed of metal, e.g., stainless steel, aluminum, etc. Preferably, however, they are formed of plastic, e.g., polyethylene, polystyrene, polypropylene, nylon or the like such as by blow molding, injection molding, sheet stamping or other suitable fabrication method. The rack may be formed as with integral base, back and sides or these members and the parts, e.g., ribs, may be separately formed and welded or cemented together. The same would apply to the fabrication of the gate 46 and containers 4.

In the embodiment shown in FIGS. 8 and 9, the containers 4A do not have runners and the base of the rack 6A is modified as compared with rack 6 of the embodiment shown in FIGS. 1-5.

The containers 4A have fronts 8 and backs 10 similar to those of containers 4, but the bottoms 104 and tops 106 differ. The tops 106 have a circular recession 108 defining the threaded opening 110 that receives the threaded cap 112 so that the top surface 114 of the cap 112 is flush with the top surface 116 of the top 106.

The rack 6A comprises back 44, parallel sides 42 and base 40A. The latter comprises front transverse rib 118, center transverse rib 120, rear transverse rib 122, side longitudinal ribs 124 and central longitudinal ribs 126. The transverse ribs are progressively higher from front to rear so the integral longitudinal ribs 124 and 126 slope downwardly from rear to front of the rack 6A. The bottoms 104 of containers 4A slope downwardly from back to front at a corresponding angle so that the tops 106 of containers 4A will parallel the shelf 76 upon which the rack 6A is placed in a refrigerator. This allows the tops of the containers to present a flat, unencumbered surface which can be used as a shelf. Since a container 4A, when removed from the rack 6A, moves slightly downwardly, large articles stored across the tops of the containers can remain undisturbed by removal of only one container 4A.

The upper surface of ribs 126 carry chamfered projections 128 to serve as slide guides for the containers 4A as they are inserted into the rack 6A.

FIG. 10 shows another embodiment of beverage dispensers of the invention. The containers 4B have bottoms 104 similar to containers 4A while the tops 12 and caps 20 are like those of containers 4. The rack 6B comprises a front transverse rib 118, central transvere rib 130 rear transverse rib 132 and side longitudinal ribs 134. No central longitudinal central ribs are used in the rack 6B. The rear rib 132 is formed with a ledge 136. When inserted in the rack 6B, the containers 4B will rest at their rear on the ledge 136 and at their front on the top surface 138 of front rib 118.

In any of the embodiments of containers 4, 4A or 4B, the bottoms and tops may be parallel rather than angled. This, of course, would not effect the bottom sloping feature of the dispensers, but would result in having the container tops also slope rather than be level as with the illustrated embodiments.

The caps 20 or 112 can be made relatively loose fitting so that air will be able to pass into the openings 18 or 110 when liquid is withdrawn from the container. However, to avoid creating a vacuum in the containers on liquid discharge a vented cap 140 (see FIG. 11) may be used. The cap 140 is provided with a vent hold 142 and this is covered on the bottom with a resilient flap 144. The flap with normally close off the hole 142, but when liquid 32 is withdrawn from the container 4, the flap 144 will be drawn down as shown in phantom line to admit air into the container.

The containers of the new refrigerator dispensers may be easily filled through their capped openings 18 or 110. These relatively large openings also enable the containers to be easily cleaned between fillings, e.g., when a container would be used to dispense milk. The push-button spouts 24 allow persons, even children, to readily obtain a cup or drinking glass full of cooled drink without need to remove a beverage container from the refrigerator. However, since the dispensers 2 are not permanently attached in any way to the refrigerator, the container and rack assembly may be removed in cooled condition from the refrigerator and taken to another place, e.g., a picnic park, for dispensing a variety of cooled drinks. This adds versatility to the dispensers. Moreover, because of their structure, they can be made relatively light in weight and can be molded from inexpensive plastics in large quantities so they may be sold at relatively low cost.

The embodiments of the invention in which an exclusive property or privilege is claimed are defined as follows:

1. A refrigerator beverage dispenser comprising a plurality of substantially equal size containers having a concave front and substantially flat back, top, bottom and parallel sides, the length of said sides being greater than the width of said front and back, a rack comprising a base, parallel sides and back and a gate carried on said base at the front of said rack, latch means to fasten said gate in a closed position to enclose said containers in said rack, said rack base comprising parallel longitudinal ribs that exceed in number by one the number of said containers and at least three parallel transverse ribs, said longitudinal ribs being spaced apart from each other approximately the width of said containers and have recesses in their upper surfaces into which a portion of said containers extend when the containers are positioned in said rack, a spout fixed on the front of each said container at the base thereof through which liquid in the container may flow on demand, a filler opening in the top of each container and a removable cap closing each said opening, said containers being held in said rack so that the bottoms thereof slope downwardly toward the front of said rack.

2. The refrigerator beverage dispenser of claim 1 wherein said recesses are guide grooves and the portion of said containers that extend into said grooves are parallel runners extending longitudinally along the bottom of the container.

3. The refrigerator beverage dispenser of claim 2 wherein the forward end of said guide grooves flare outwardly to facilitate insertion of said container runners into said grooves.

4. The refrigerator beverage dispenser of claim 3 wherein said runners taper downwardly in height from the back towards the front of the containers providing a forward pitch to the bottom of the container.

5. The refrigerator beverage dispenser of claim 2 wherein said transverse ribs extend below the lower horizontal level of said longitudinal ribs providing bearing surface for said rack upon the shelf of a refrigerator.

6. The refrigerator beverage dispenser of claim 1 wherein the rack base has front, center and rear transverse ribs that are progressively higher from front to rear, said longitudinal rib slope downwardly from rear to front of said rack and the bottoms of said containers slope downwardly from back to front of the containers at an angle corresponding to the slope of said longitudinal ribs whereby the tops of said containers will parallel the shelf upon which the rack of said dispenser is placed in a refrigerator.

7. The refrigerator beverage dispenser of claim 6 wherein the caps on said containers are recessed below the upper surface of the container tops.

8. The refrigerator beverage dispenser of claim 1 wherein said caps are valved to admit air into the containers to replace liquid withdrawn therefrom.

9. The refrigerator beverage dispenser of claim 1 wherein a stop flange depends from said rack at the front thereof.

* * * * *